United States Patent [19]

Knight et al.

[11] 4,203,232

[45] May 20, 1980

[54] NIGHT EFFECTS SIMULATOR

[75] Inventors: Lindsay C. Knight, Albury, Australia; Roy E. Casey, Columbia, S.C.

[73] Assignee: Australasian Training Aids Pty. Ltd., Albury, Australia

[21] Appl. No.: 873,924

[22] Filed: Jan. 31, 1978

[30] Foreign Application Priority Data

Feb. 2, 1977 [AU] Australia ..... PC8916

[51] Int. Cl.[2] ..... F41G 3/26

[52] U.S. Cl. ..... 35/25

[58] Field of Search ..... 35/25; 273/101.1, 102.2 S, 273/102.1 C, 102.2 R

[56] References Cited

U.S. PATENT DOCUMENTS

| | | | |
|---|---|---|---|
| 2,404,653 | 7/1946 | Plebanek | 273/101.1 |
| 3,737,166 | 6/1973 | Knight | 273/102.2 S |

FOREIGN PATENT DOCUMENTS

| | | | |
|---|---|---|---|
| 276215 | 10/1965 | Australia | 35/25 |
| 1118015 | 6/1968 | United Kingdom | 35/25 |

*Primary Examiner*—William H. Grieb

*Attorney, Agent, or Firm*—Schwartz, Jeffery, Schwaab, Mack, Blumenthal & Koch

[57] ABSTRACT

A night effects simulator to permit night firing under simulated battlefield conditions. A group of targets are first at least momentarily illuminated for observance by the trainees. A second illuminating means is provided for illuminating said target responsive to said target hit, with the second illuminating means displaying on said target a light visually distinguishable from the light provided by said first illuminating means. A third illuminating means simulates return fire from the target, and displays on the target a light visually distinguishable from the light provided by the first and second illuminating means. The light for first illuminating the target may be blue and may be such as to silhouette the target to simulate moonlight conditions. The light for displaying a target hit may be white, and the light for simulating return fire may be red. Control means may be provided for sequencing the lights as desired.

51 Claims, 16 Drawing Figures

NIGHT EFFECTS SIMULATOR

SUMMARY OF THE INVENTION

The present invention relates to night shooting and particularly but not exclusively to a night effects simulator used for lighting a target or targets on a firing range so as to provide a realistic effect of battlefield combat at night.

Night shooting apparatus of this general type is known and is disclosed in Australian Pat. No. 276,215, the apparatus disclosed therein being used in conjunction with a target moving mechanism which moves a target between concealed visible positions. In order to practice marksmanship under night conditions, the apparatus disclosed in the Australian patent includes means for directing momentarily a white flood light onto the target so as to indicate the outline of a fleeting target, the idea being that the marksman must fire at the target when it is so lit. If the marksman scores a hit the target is then illuminated by a red light thus giving a visual representation of the target hit.

The Australian patent teaches use of simulated retaliatory fire, wherein a shot or larger explosive is detonated; U.S. Pat. No. 2,404,653 to L. Z. Plebanek discloses a "standing rabbit" target which carries a miniature rifle, the rifle having a lamp directed away from the rabbit to simulate retaliatory fire when energized. The Plebanek patent discloses an electric target game of the type found in amusement arcades, and a mild shock is given the player of the game in the event the target is not hit before it reaches a predetermined point in its path of movement. If the target is hit, the hit is registered, with no shock being given, and the face of the animal can be illuminated to visually show the hit.

The described prior art does not attempt to train a marksman in night shooting under simulated battlefield conditions, and the present invention has been devised with this object in mind.

The basic concepts of the invention include the silhouetting of the target for predetermined lengths of time and intervals; visually indicating a target hit by illuminating the target for a time period immediately after the hit, and visually simulating retaliatory fire at intervals predetermined as to timing and duration. According to the preferred form of the invention, the night shooting apparatus includes means for generating and projecting light towards the target so as to illuminate the target, at predetermined periods, in one of three colors visible to the marksman. One color is for illuminating the target for sight purposes. The second color is for illuminating the target to indicate a hit, and the third color is for illuminating the target for simulating retaliatory fire.

Most preferably, the first color is blue to provide an artificial silhouette effect, the second color is preferably white and provides hit indication, and the third color is desirably red and relatively small in beam diameter in order to more accurately simulate retaliatory fire. The colors may be generated from a single lamp source and passed through suitable filters to appropriately color the light which is to be observed by the marksman. Alternatively, separate lamp sources can be used and positioned and spaced from the target as desired. Either the silhouette target or the red simulated retaliatory fire, which are not normally displayed simultaneously, can be used for sight purposes by the marksman.

With further regard to the lamp arrangement, two lamps may be positioned in one casing and a third lamp in a second casing. The lamps in the first casing may be positioned in front of the target and directed so as to alternately project red light or white light on the target thereby providing simulated retaliatory fire and hit indication, respectively. The second casing containing a third lamp may be mounted behind the target so as to project blue light onto the rear of the target, thereby providing a silhouette effect.

A lens is associated with each lamp for providing the desired divergence of light onto the target. The lenses for the white light and the blue light are such as to provide a wide angle of divergence in order to illuminate the whole of the target. The lens associated with the red light preferably has a narrow angle of divergence so that a spot image of red light simulating return fire will appear on the target, preferably centrally and somewhere in the top half of the target.

The red light means is preferably operatively connected to a switching means which supplies pulsed current to provide light pulses. The pulsed red light more closely simulates automatic rifle retaliatory fire, and the red light observed will resemble red sparks at the target. The switching circuit may include a clock which is adapted to run at any desired speed which will cause light pulses to be visible to the eye, for example, less than 25 Hertz. Higher frequencies, such as 600 Hertz may be employed if desired, which would provide a continuous beam, and for this purpose the clock may be adapted to have a continuously adjusted frequency rate. The clock in turn is operatively connected with a gating switch which supplies current to the lamp in accordance with the pulses produced by the clock.

The light means may be a laser emitter or strobe lamp which has to be triggered with pulses occurring at a repetition rate of approximately 600 Hertz, and in order that a light pulse be observed, groups of such pulses may be passed to the light means so that each group has the required duration and time spacing between the next group to give the desired effect.

In preferred use, the night effects simulator range includes a control console operatively connected to the light means either by cable or by a radio link so that silhouette illumination or retaliatory fire can be signalled by the controller of the range. The white light means for hit indication is operatively connected with a hit sensing means on the target so as to illuminate the target when it is so hit and without operation of control switches by the controller of the firing range. The hit sensing means per se forms no part of the present invention, and may be operatively connected to a target moving mechanism for dropping the target to likewise indicate a target hit. In such event, the subsequent raising of the target is followed by the reinitiation of the blue light.

The controller of the range can control the retaliatory fire, and can select one of the clock pulses or a selected group of the control clock pulses to visibly indicate single return fire or automatic rifle retaliatory fire. For example, one, three or five bursts of return fire can be simulated. This may also be effected automatically.

The silhouette and return fire functions may be obtained in two ways. First, a control signal activates the silhouette light, thereby exposing the target. Then, the control circuit automatically will await a second transmission of the control signal which, when received within 5 seconds of the first such signal, will activate the return fire light. However, if the trainee hits the target within the 5 second interval, the target will automatically drop and the control circuit for the blue lamp will be reset so that the next received control signal will again activate the silhouette lamp.

It can thus be seen that the range operator has the option to expose the target with a blue silhouette light, return the fire of the trainee if the trainee misses the target, or not return the fire of the trainee, knowing that the night effects simulator will reset to display the blue silhouette light after a 5 second interval.

Filters for the light means may be provided with the lenses to visibly color the lights to the required brightness and color. Additionally, the current which is supplied to the retaliatory fire light may be a ramp type current whereby the light is initially of bright intensity and slowly decays in intensity. Thus, a more realistic simulation of retaliatory fire can be presented. Alternatively, dimming may be accomplished by supplying the lamps for silhouetting or hit indication with a square wave power source which is adjustable by the range controller. It will also be appreciated that the retaliatory fire lamp may project a beam which has a red spot in the center and which is surrounded by an orange color, thereby even more realistically simulating retaliatory fire.

In order to reinforce the retaliatory fire effect, the target may have light reflective tape mounted thereon at selected locations where retaliatory fire is to be observed, thereby enhancing the intensity of the observed red light. For example, such tape may be 5 cm.×5 cm. and colored red. Further, the tape may be suitably coated to reflect or luminesce only when incided by columnated light which the light means may be specifically adapted for. Alternatively, the retaliatory light means may be white light, columnated or otherwise, and directed to shine onto a red coated tape or a red coating of suitable material on the target, so that the observed red light is provided only by the reflecting material.

In a further modification, one or more of the lights, particularly the light used for simulating retaliatory fire, may be mounted with adjustable means whereby the position of the projected light can be changed vertically or horizontally on the target. This is particularly desirable in order to provide correct lighting of the target when, for example, a standing man target is replaced in the target mounting mechanism with a kneeling man target. To achieve such adjustment, the lens assembly may be movable, the casing may be provided with means whereby it can be tilted relative to the target moving mechanism, or the lens may be associated with a tiltable mirror within the casing to vary the direction of the beam. In a still further modification, the casing may be provided with a lever for tilting and the base of the casing may be provided with stop means, such as a spring loaded ball which locates in a detent, to correctly align the projected light onto the target for known size targets. It will be understood that similar means can be provided for moving the center of the projected light horizontally across the target.

The present invention also includes circuit means for controlling as desired the projection of lights on the target as described. The control may be by the range operator or partially or entirely automatic, as will be described.

These and other objects of the invention will become apparent as the following description progresses, with particular reference to the application drawings.

BRIEF DESCRIPTION OF THE APPLICATION DRAWINGS

FIG. 1 comprises a schematic perspective view of the night effects simulator range comprising the present invention, with three separate banks of targets being shown, each of which is operatively connected to a control tower for operation of the range;

DETAILED DESCRIPTION OF THE PREFERRED EMBODIMENTS

Figure 1:
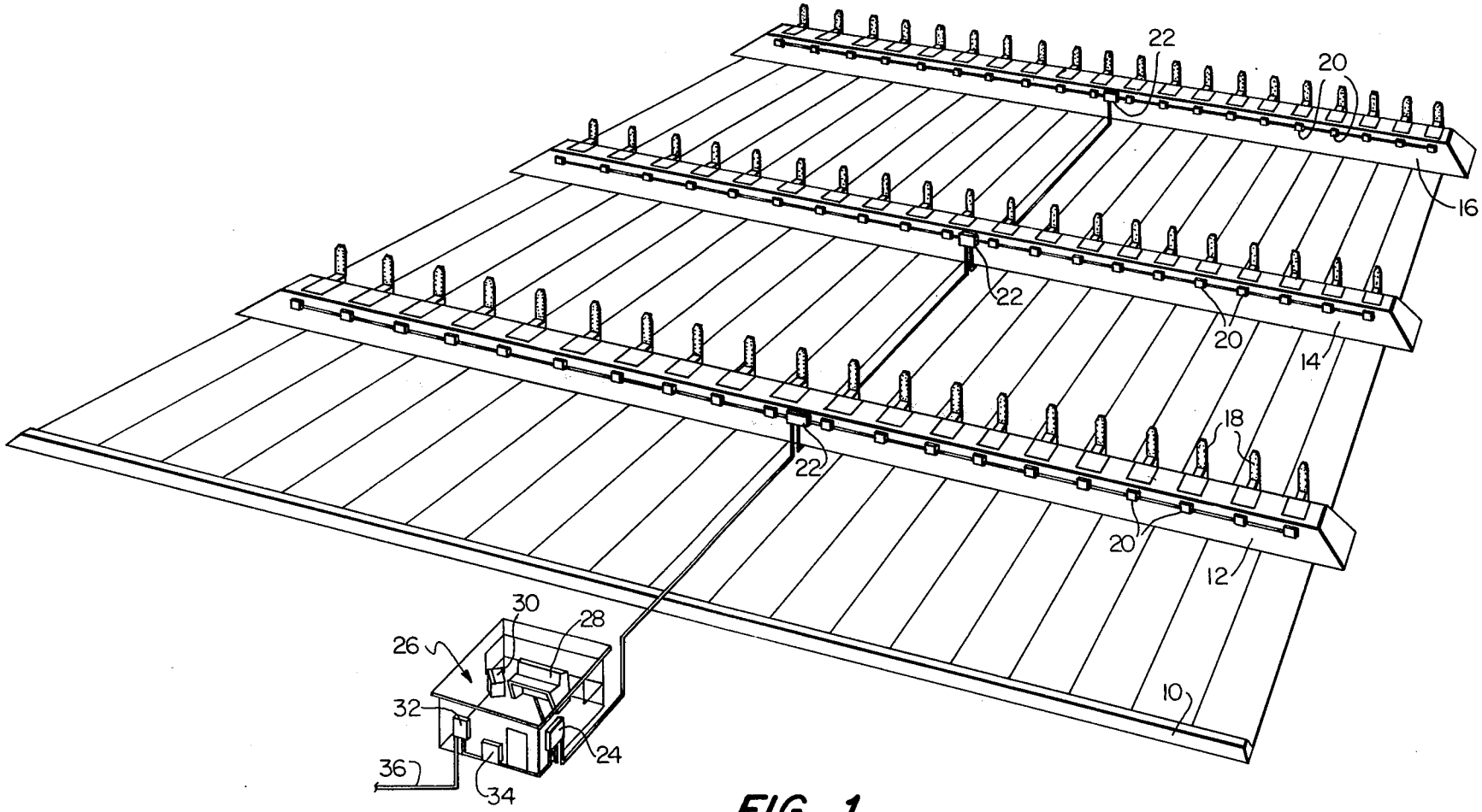

Referring now in detail to the application drawings, wherein like parts are indicated by like reference numerals, reference is initially made to FIG. 1 which schematically illustrates the night effects simulator range comprising the present invention. The range includes a firing line 10 at which are positioned the trainees with weaponry. Schematically shown are three banks of target installations, 12, 14, and 16, respectively, but it will be understood that a single bank may likewise be provided, or further banks in addition to those illustrated. The banks 12, 14 and 16, can be spaced from the firing line 10 at specified distances, for example, 25, 50 and 75 meters, respectively. The width of the range can be selected to accommodate the desired number of trainees for simultaneous range firing, with a range width of 100 meters constituting a typical installation.

As well known in the art, the firing line 10 is divided into a series of firing lanes each of which accommodates a trainee or marksman, with a target commonly designated at 18 being positioned in each lane. Although the targets in each bank 12, 14 and 16 are shown in an "up" position in FIG. 1, it will be understood that only those targets for the bank which is being fired on will be elevated.

A separate power supply commonly indicated at 20 is provided for each target, with the power supply providing the necessary energy for performing the control functions at each target, for example, the projecting of the lights on each individual target, processing the hit detection signal for each target to the central control source for the range, and forwarding any necessary control signal for the target. Each power supply 20 in the form shown is serially connected to a bank power distribution box 22 provided for each bank 12, 14 and 16, with the distribution box 22 in turn being operatively connected to a wall box 24 shown schematically mounted on the control tower, generally indicated at 26.

The control tower 26 may further include a control console 28, a teletypewriter 30, a mains switch board 32 and a voltage regulator 34. A mains supply line 36 leads to the switch board 32.

It will be understood that the components associated with the control tower are only schematically shown and generally described, and the present invention does not relate to the details of these control parts, except for the circuitry to be hereinafter described. It will further be understood that a range controller or controllers will be positioned in the control tower for operation of the range, either manually, or partially or entirely automatically.

Figure 2:
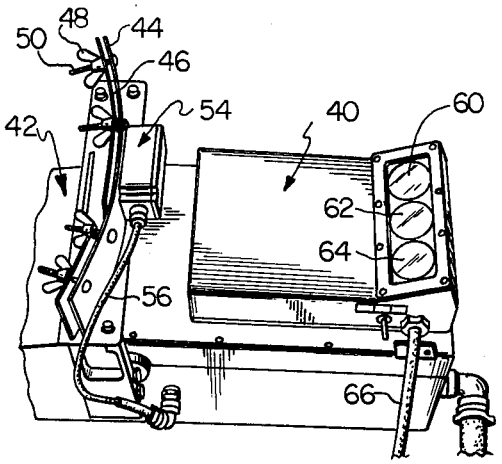
FIG. 2 illustrates one form of the invention in which a single casing having mounted therein three separate light means is positioned adjacent a target holder in which a target (not shown) may be mounted.

Referring to FIG. 2, there is illustrated therein a casing or housing generally indicated at 40 which contains the light projecting means for illuminating the target in the desired manner. The casing 40 is mounted adjacent a target support member generally indicated at 42 which includes target engaging base portions 44 and 46 between which the target can be positioned and clamped. Clamping nuts 48 are mounted on threaded studs 50 which extend through the space between the base members 44 and 46, with the latter being curved in the form shown in FIG. 2. The details of the target mounting mechanism per se form no part of the present invention, and reference is directed to U.S. Pat. No. 3,737,166, granted June 5, 1973, to Lindsay Charles Knight, in which a target holder of comparable type is described and claimed. Likewise, the construction of the targets per se, shown schematically in FIG. 1, form no part of the present invention, and can be of the type shown in U.S. Pat. No. 3,737,166, which also discloses the manner in which the target extends over the threaded studs and is clamped between the base members.

A hit detection device generally indicated at 54 is mounted adjacent the base members 44 and 46 of the target mounting mechanism. Similarly, the device 54 per se forms no part of the present invention, and functions to detect a hit on the target and provide a signal responsive to said hit.

The hit detection device 54 is operatively connected by cable 56 to the housing or casing 40 whereby the latter can be controlled to visually indicate the target hit, for example, by white light being projected on the target as above described. The hit detection device may comprise a transducer which functions when the target is hit to close a switch for consequent hit indication. As described in U.S. Pat. No. 3,737,166, when the target mounted on the target holder is struck by a bullet, the impact is transferred to the transducer for completion of the switch closing, with the transducer mechanism being such that it will register only when hits, as contrasted with near misses, exist at the target.

It will be noted in FIG. 2 that three separate lamps 60, 62 and 64 are illustrated, mounted in the single casing or housing. These lamps provide blue, red and white light, respectively, for projecting onto the target positioned immediately adjacent to the casing on the target holding mechanism. A cable 66 is operatively connected to the lamps for providing energy therefor. As above described, the preferred form of the invention includes the provision of two separate housings, the first being positioned behind the target and containing the light means for projecting blue light onto the rear of the target for achieving the silhouette effect, and the second casing being positioned in front of the target and containing the light projecting means for the red and white light. Although FIG. 2 illustrates all of the light projecting means enclosed in a single housing, it will be obvious that a second housing containing only the source of blue light could be independently provided and mounted on the opposite side of the target, and there is accordingly believed to be no need for showing the alternative construction.

Figure 3:
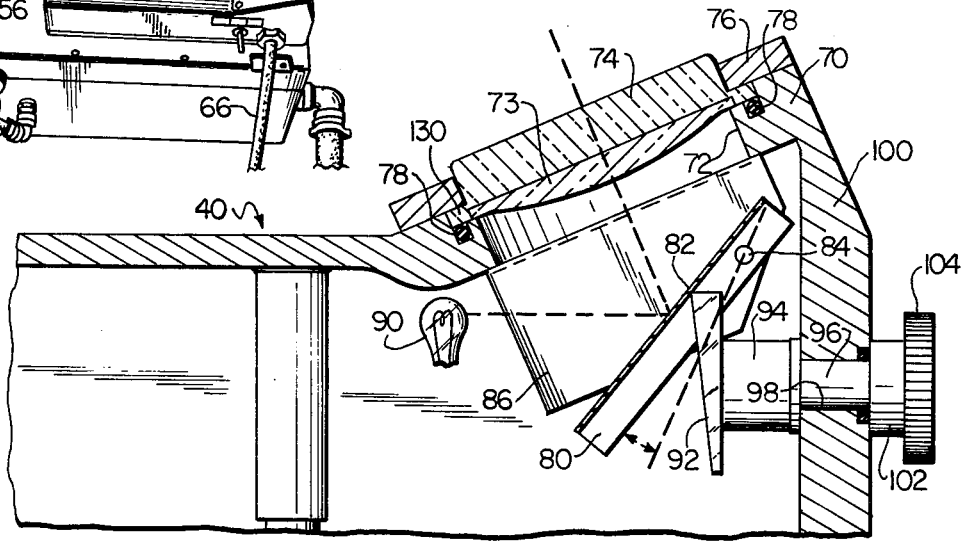
FIG. 3 is a fragmentary cross-sectional view through a portion of the casing shown in FIG. 2, illustrating in more detail the light means for simulating retaliatory fire, and the manner in which the beam of projected light can be variably adjusted as to direction.
Figure 4:
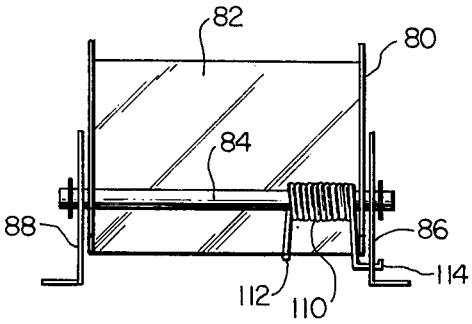
FIG. 4 is an end view of a portion of FIG. 3, showing the manner in which the reflecting mirror is mounted on brackets secured in the casing.
Figure 5:
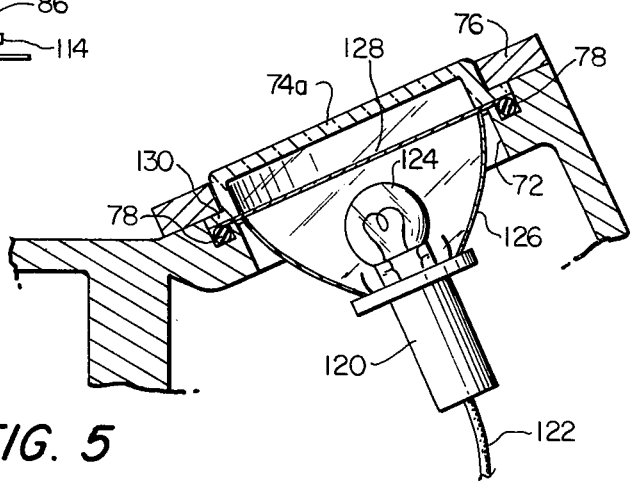
FIG. 5 is a fragmentary cross-sectional view illustrating the mounting of the lamps for projecting light on the target for silhouette and hit indication purposes.

Reference is now made to FIGS. 3–5 which show the manner in which the light projecting means are mounted in the casing 40. Referring to FIG. 3, which constitutes an enlarged, fragmentary cross-sectional view through the lens and mounting therefor for retaliatory fire, the top wall 70 of the casing is inclined as shown and provided with a rectangular opening 72 which extends substantially across the width of the casing to accommodate the lens for the lamps. The lens for the red, simulated return fire is shown at 74 and is generally convex in cross-section to provide the converging light effect to produce the spot image on the target for simulating retaliatory fire. The full convexity of the lens 74 does not appear in FIG. 3, which shows only the maximum thickness of the lens. A lens-filter 73 is mounted over the lens 74, with the filter providing the red light. The lens 74 is retained in place by lens cover 76 which is positioned over the inclined housing and secured thereto in any suitable manner. Sealing means, commonly designated at 78, are positioned in openings therefor formed in the wall 70 for sealing the interior of the housing.

As above noted, the light source for retaliatory fire is desirably mounted for adjustment so as to permit the desired positioning of the retaliatory fire spot image on either a standing man or a kneeling target, or possibly other target configurations. The arrangement illustrated in FIG. 3 for permitting the necessary adjustment comprises a support member 80 formed with a mirror surface 82 generally facing the lens 72, with the member 80 being mounted on rod 84 which extends through brackets 86 and 88, mounted on the casing, with the brackets being shown in more detail in FIG. 4. A lamp 90 is mounted below the inclined wall 70 of the casing and laterally of approximately the midpoint of the mirror surface 82, with the light provided by the lamp 90 thereby being reflected off the mirror surface and through the lens 74. By adjusting the tilting orientation of the mirror surface 82, a narrow beam of light, pulsed or continuous, can be directed as desired to vertically spaced areas on the target.

The member 80 containing the mirror surface 82 is adjusted relative to the vertical by means of a cam 92 which is carried by a hub 94 secured to a shaft 96 which extends through an opening 98 therefor formed in the rear wall 100 of the casing. The shaft 96 is enlarged as shown at 102 outwardly of the casing and is formed with a knurled end 104 by means of which shaft 96 and thus the cam 92 can be rotated.

Referring to FIG. 4, the member 80 is biased counterclockwise, referring to the FIG. 3 orientation thereof, by means of a coil spring 110 one end 112 of which engages under the member 80 and the opposite end 114 of which engages bracket 86. In this manner, the part 80 is continuously resiliently biased against the surface of the cam member 92 whereby rotation of the cam serves to correspondingly rotate the member 80 about the axis through the rod 84. Thus, as the cam member 92 is rotated between its FIG. 3 position in which the thickest part of the cam surface engages the mirror surface 82, and the radially reduced opposite end thereof, the member 80 rotates counterclockwise, and the approximate degree of rotation of the member 80 is shown by arrows and a dashed line in FIG. 3.

Referring to FIG. 5, there is shown therein the mounting for the silhouette and hit lamps which project, respectively, blue and white light onto the target surface. The mounting for each lamp is identical and the following description will apply to both.

A lamp housing 120 connected to the power supply by line 122 carries a lamp 124, with the lamp and housing being carried by a reflector member 126 which is mounted in sealed relation in the opening 72 formed in the top wall of the casing. The lens is shown in FIG. 5 at 74*a*, and it will be observed that the lens is neither concave nor convex so that the blue or white projected beams illuminate the entire target.

FIG. 5 illustrates the mounting of the silhouette lamp, and a filter 128 is provided mounted below the lens 74*a* to filter blue light through the lens.

The lenses 74, 74*a* may each be integrally formed as a single member for sealed mounting in the opening 72. The lens above the lamps for blue and white light are formed flat as shown in FIG. 5, and the lens for retaliatory fire is convexly enlarged as shown in FIG. 3 to provide the confined light beam. As shown in FIG. 3, the lens assembly for the red light may comprise two parts integrally secured together as shown, and the filter for the red light combined therewith. As shown both in FIGS. 3 and 5, the lens is formed with a lateral flange 130 which extends around the entire periphery thereof for mounting in the recessed opening formed in the casing wall, with the lens being sealed in position and covered by the lamp cover 76.

Figure 6:
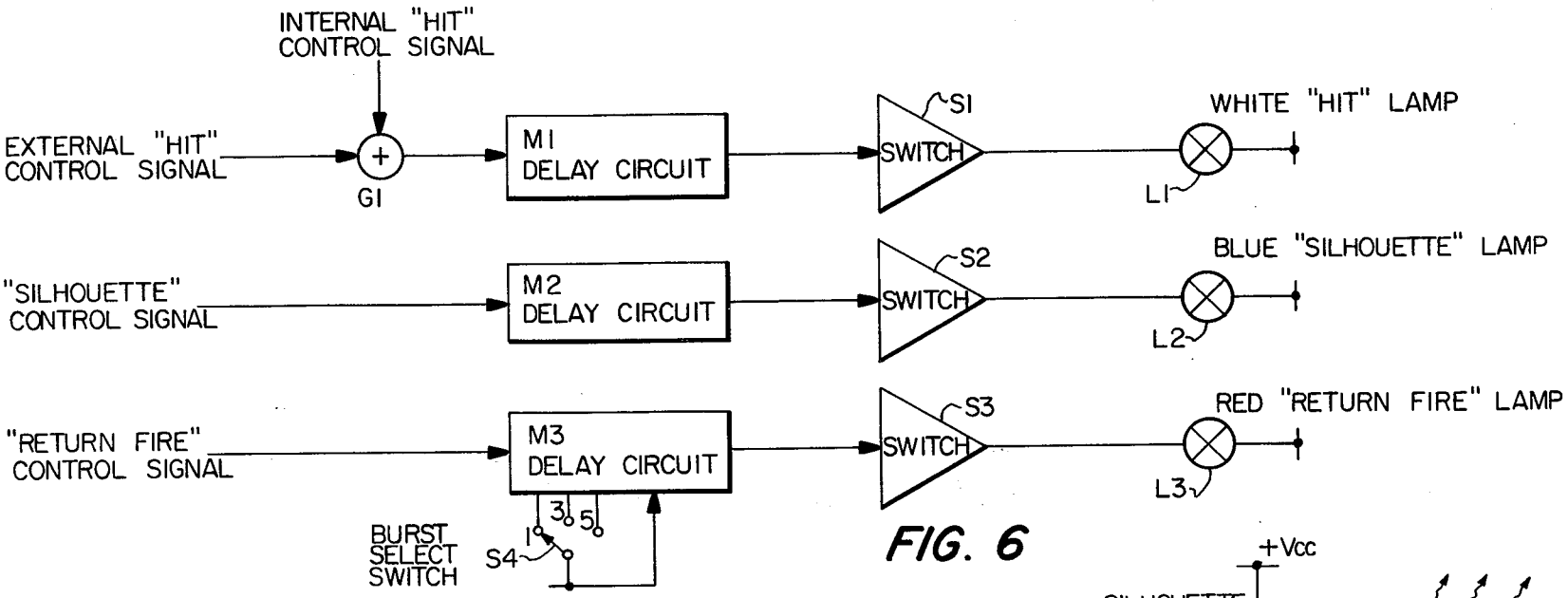
FIG. 6 shows in block diagram form the circuit arrangement for controlling the hit lamp, silhouette lamp and return fire lamp for the night effects simulator.

Referring now to the control circuits for the simulator range, FIG. 6 illustrates in block diagram form the basic simulator circuitry. In the upper portion of FIG. 6 is shown the hit circuit, which includes an OR gate G1, a delay circuit M1, a switch S1 and a white lamp L1. Gate G1 provides an output signal to the delay circuit M1 when an internal hit control signal is received from the target mechanism in response to the trainee hitting the target. Gate G1 also provides an output signal when an external hit control signal is received from the control panel operated by the trainer. In either case, a pulse is provided to delay circuit M1, which holds the input signal such that the hit lamp will be illuminated for 0.5 seconds after either the internal or external control signal is received. The output of delay circuit M1 controls electronic switch S1 to energize the white hit lamp, thereby illuminating fully the target.

In the center portion of FIG. 6 is shown in block form the circuit for activating the blue silhouette lamp. The silhouette control signal is provided to a delay circuit, M2, which controls a switch S2 to light the blue lamp.

The return fire circuit is shown in block form at the bottom of FIG. 6. The return fire control signal is provided to a delay circuit M3, the delay circuit having a burst select switch S4 associated therewith. The switch is manually operable to provide 1, 3 or 5 output pulses from delay circuit M3. The output of M3 is provided to a switch S3 for controlling the return fire lamp L3. When the burst select switch is in the "1" position, a single flash of red light from the return fire lamp will be provided. When the burst select switch S4 is in the "3" or "5" position, 3 or 5 flashes of red light from the return fire lamp will be provided, respectively.

Figure 7A:
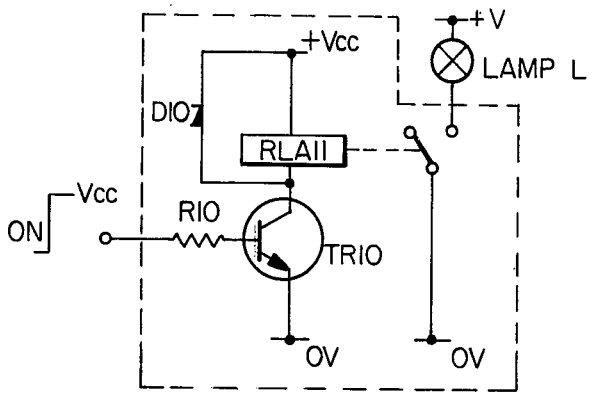
FIGS. 7A–7C show specific circuit arrangements which may be used for the switches S1-S3 of FIG. 6.
Figure 7B:
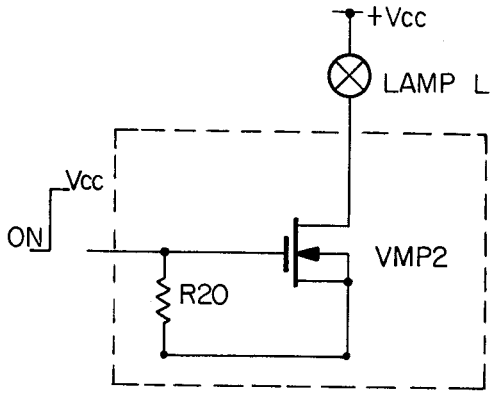
Figure 7C:
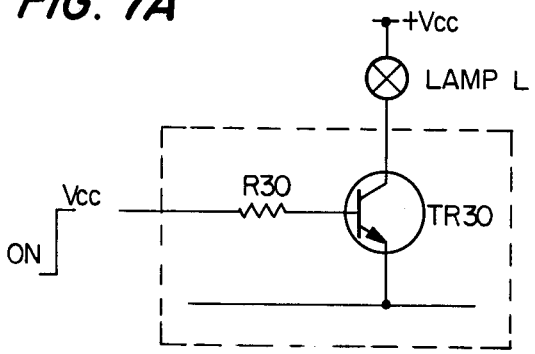

FIGS. 7A–7C show three different ways of implementing the switch functions of switches S1-S3. FIG. 7A shows an implementation including a relay RLA 11. The input signal for turning on the lamp L is provided to a resistor R10 coupled to the base of a transistor TR10. The collector of this transistor is coupled through parallel connected diode D10 and relay RLA 11 to a voltage source (+Vcc). Activating the relay causes the relay contacts to close, coupling lamp L to a voltage source (+V).

FIG. 7B shows a VMOS implementation of the controlled switches S1–S3. The input signal is provided to a VMOS such as type VMP2. Switching on the VMOS causes lamp L to light.

FIG. 7C shows a transistor implementation of switches S1–S3 in which the control signal is provided to a base resistor R30 of transistor TR30. Switching on the transistor causes lamp L to light. The following description of detailed circuitry will show the embodiment of FIG. 7C, although any of embodiments 7A–7C could be used.

Figure 8:
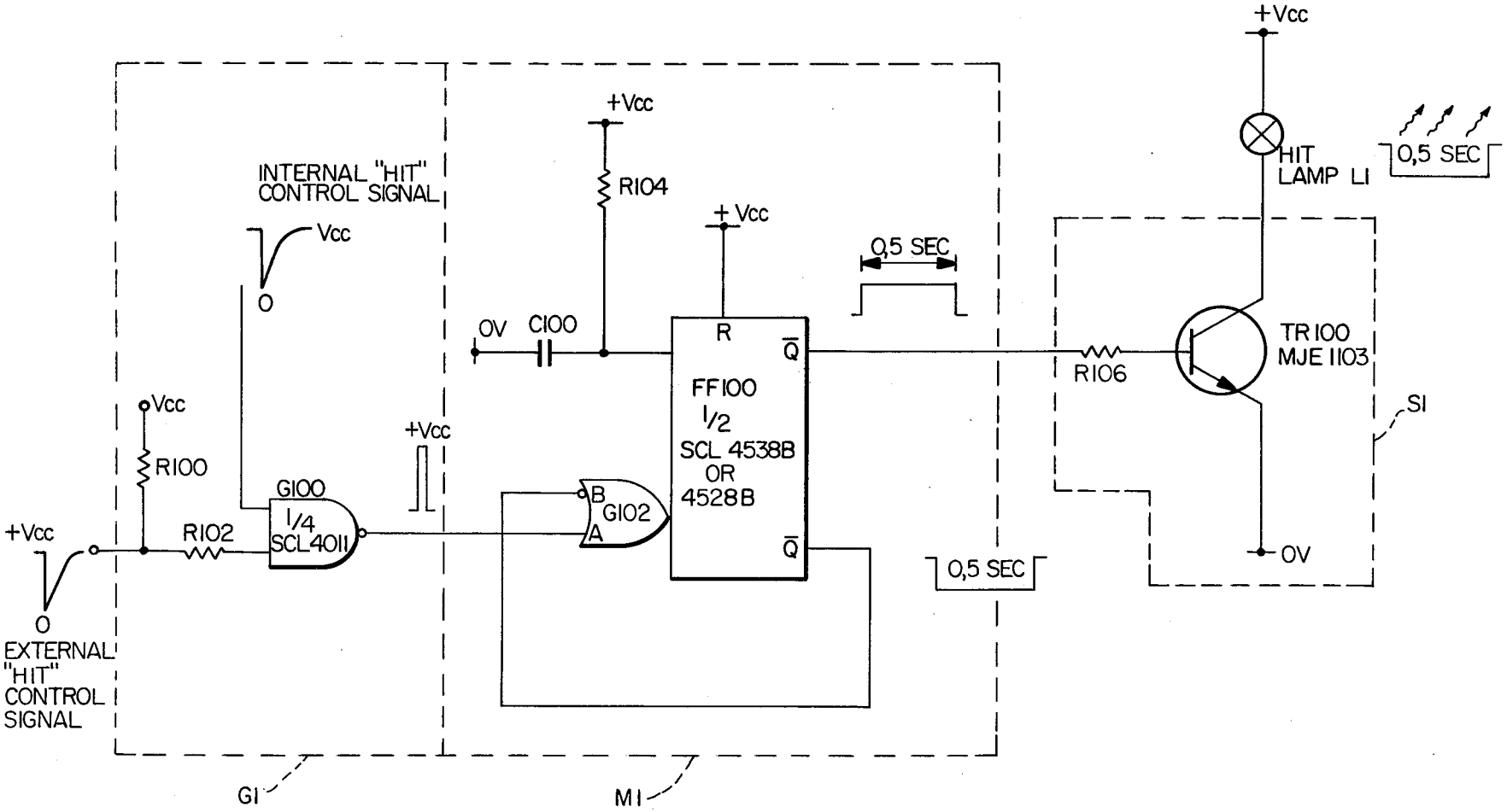
FIG. 8 shows a detailed circuit diagram of Gate G1, delay circuit M1 and switch S1 of FIG. 6.

FIG. 8 shows a more detailed circuit implementation of the hit circuitry shown in the upper portion of FIG. 6. In particular, detailed circuit arrangements are shown for gate G1, a delay circuit M1 and switch S1. Gate G1 comprises bias and input resistors R100 and R102, as well as NAND gate G100. Gate G100 provides a positive output (+Vcc) when a negative-going hit control signal pulse is provided at either one of its inputs. The external hit control signal could be from the console operated by the trainer, while the internal hit control signal is provided by an appropriately connected conventional shock detector, e.g. a transducer or the like mounted adjacent the target. When the trainee hits the target the internal hit control signal is generated. A positive pulse output from NAND gate G100 is provided to a non-inverting input of OR gate G102. The output of gate G102 is provided to an input of flip-flop FF100 (which may be ½ of a circuit chip type SCL 4538B or 4528B), coupled to operate as a monostable element. Resistor R104 and capacitor C100 provide the necessary R-C time constant so that the monostable element will stretch the input signal to allow 0.5 seconds lamp-on-time. The $\overline{Q}$ output of FF100 is provided to an inverting input B of Gate 102. Thus, when either an internal or external hit control signal is received by an input of Gate G1, the output of delay circuit M1 is "high" for 0.5 seconds. This "high" signal is provided to switch S1 (shown implemented as in FIG. 7C). Transistor TR100 of switch S1 may be of type MJE1103, for example. It can be seen that the hit lamp will be lit for 0.5 seconds as a result of the reception of a hit control signal.

Figure 9:
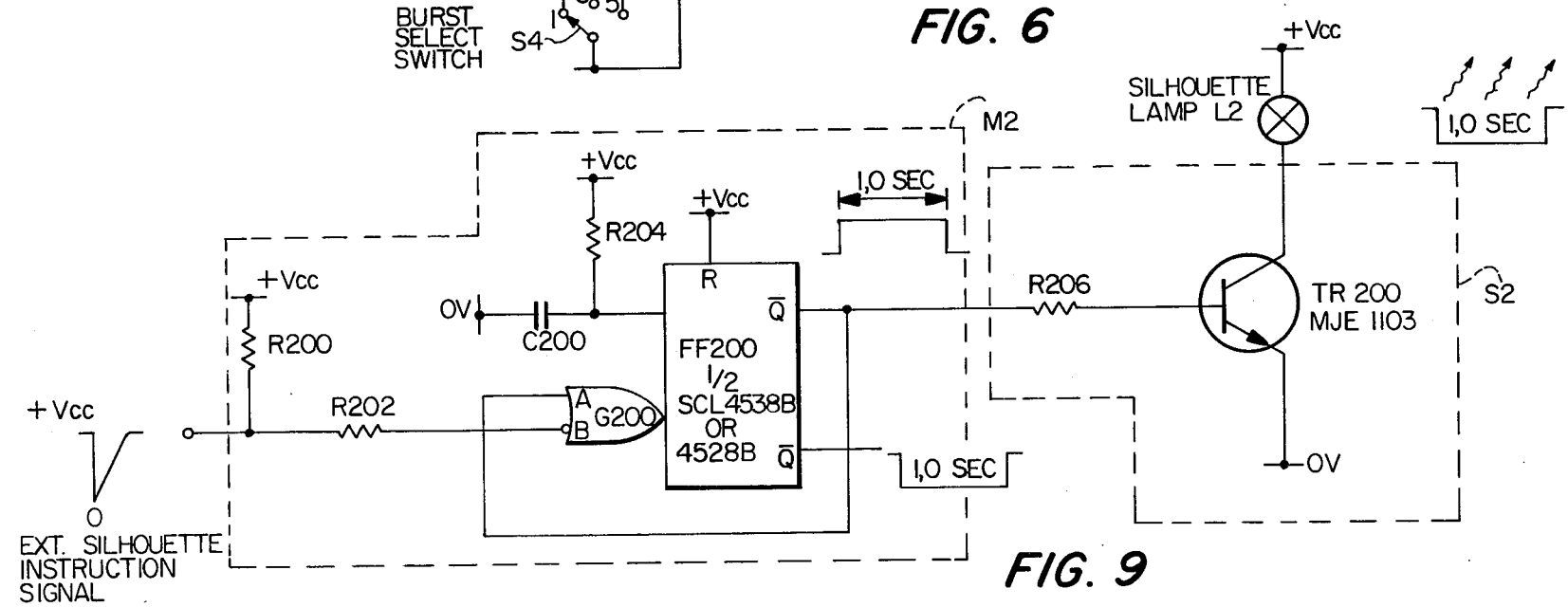
FIG. 9 shows a detailed circuit arrangement for delay circuit M2 and switch S2 of FIG. 6.

FIG. 9 illustrates in more detail a circuit arrangement for the silhouette lamp control circuitry shown in the middle portion of FIG. 6. Delay circuit M2 comprises bias and input resistors R200 and R202, the latter being coupled to an inverting input of gate G200. The output of gate G200 is coupled to the input of flip-flop FF200 (which comprises ½ of a circuit chip of type SCL4538B or 4528B). An R-C time constant is provided by resistor R204 and capacitor C200 to flip-flop FF200, thereby creating a monostable element which extends the input signal for allowing a one second lamp-on-time. Thus, when a negative going external silhouette instruction signal is received at resistor R202, the output of delay circuit M2 comprises a 1.0 second "high" signal. This "high" signal is provided to input resistor R206 of switch S2 for activating the silhouette lamp L2.

Figure 10:
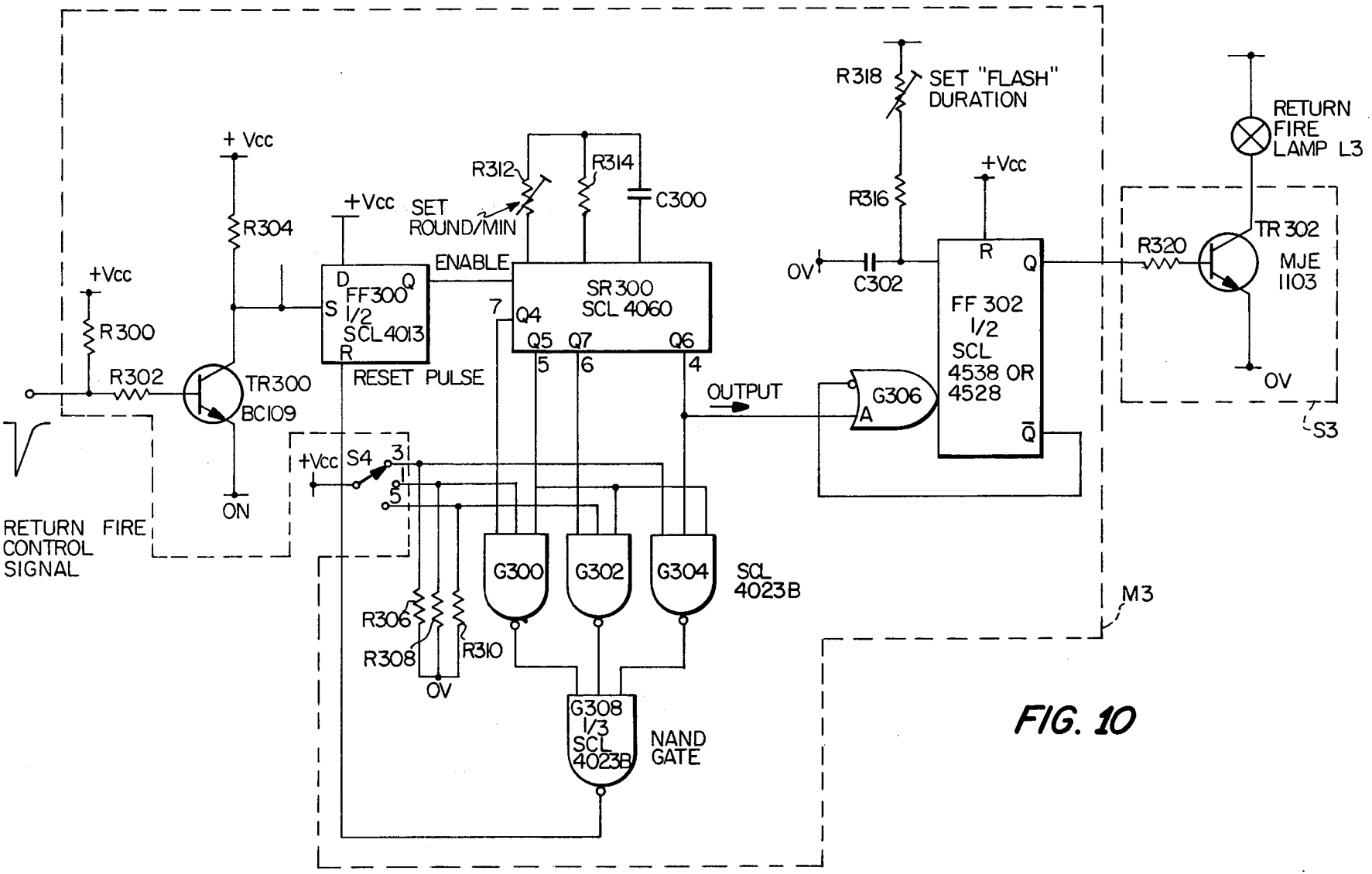
FIG. 10 shows a detailed circuit arrangement for delay circuit M3 with burst select switch S4 and switch S3 of FIG. 6.

The return fire circuitry shown in block form in the lower portion of FIG. 6 is illustrated in greater detail in FIG. 10. A negative-going return fire control signal is provided to the junction of bias and input resistors R300 and R302 of transistor TR300. Transistor TR300 may be of type BC109, for example, and have a collector resistor R304. The collector of transistor TR300 is further coupled to the "S" input of flip-flop FF300 (which comprises ½ of a circuit chip of type SCL4013). The Q output of FF300 is coupled to enable a 14 stage counter having an internal clock frequency set by variable resistor R312. Adjusting R312 causes the "rounds/minute" to be set for the return fire burst. The 14 stage counter SR300 comprises, for example, a circuit chip of type SCL 4060. The outputs Q4–Q7 of SR300 are coupled as shown to NAND gates G300–G304, the outputs of which are in turn coupled to the inputs of NAND gate 308. The output of G308 is coupled to the reset (R) input of FF300. Switch S4 allows the burst sequence to be set at 1, 3, or 5 rounds, as indicated. The output from counter SR300 is taken from the Q6 terminal and is used to trigger a variable-width monostable element FF302 (comprising ½ of a circuit chip of type SCL 4538 or 4528) to simulate the flash duration of different weapon types. The flash duration can be manually adjusted by variable resistor R318, the R-C time constant of FF302 being provided by the network of capacitor C302 and resistors R316 and R318. The output of delay circuit M3 is supplied to input resistor R320 of switch S3 for activating the return fire lamp L3 through transistor TR302. It will be apparent to those skilled in the art from the circuit diagram of FIG. 10 that the return fire control signal will cause the return fire lamp to be lit in a predetermined sequence which can be manually adjusted by setting the rounds per minute (R312), the number of flashes in the burst (switch S4), and the flash duration (resistor R318).

Figure 11:
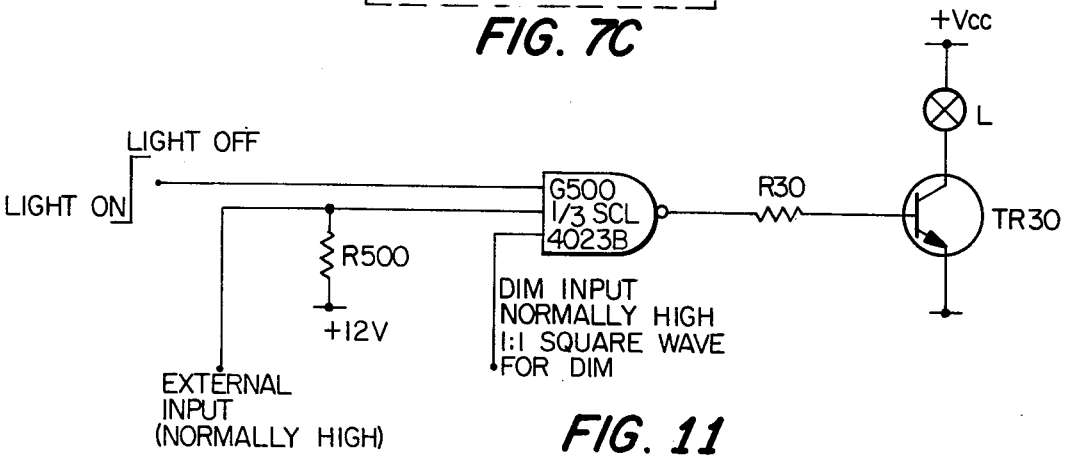
FIG. 11 shows a further modification of the circuit of FIG. 7C.

FIG. 11 illustrates still a further modification of the switches S1—S3, particularly a modification of the arrangement of FIG. 7C. The circuit of FIG. 11 shows the input resistor R30 and transistor TR30 for lighting lamp L, but the input signal previously provided directly to input resistor R30 is now coupled through a gate G500 which may comprise ⅓ of a circuit chip of type SCL4023B. The light "on" and light "off" signal is provided to the upper one of the three inputs of NAND gate G500. The center input of gate G500 is coupled for manual operation of the lamp as desired. The third input of gate G500 is coupled for permitting dimming of lamp L for the silhouette and hit lamps. The dimming function is not provided for the return fire lamp.

Figure 12:
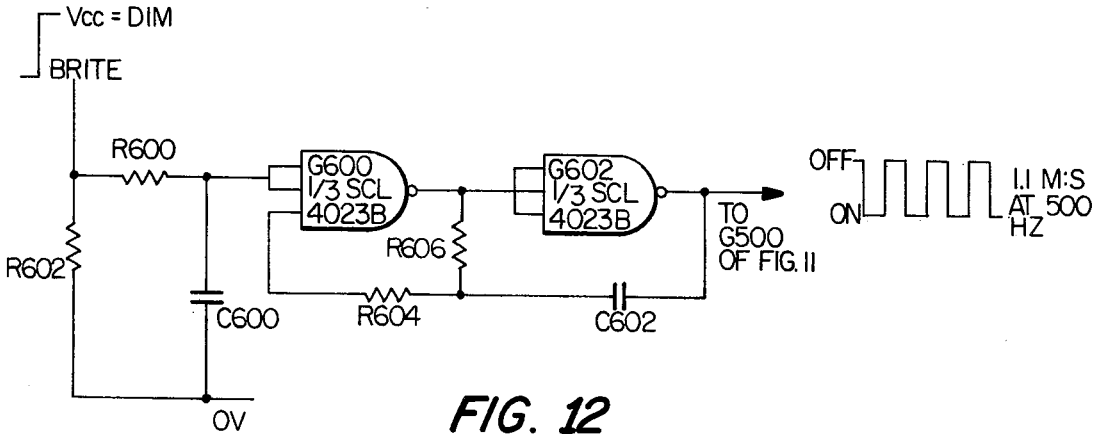
FIG. 12 shows a circuit for providing dimming of the hit and silhouette lamps.

The dimming function will now be described with reference to the circuit of FIG. 12. The instruction for "dim" or "bright" is provided, as a high or low voltage as shown at the upper left hand portion of FIG. 12, to the junction of resistors R600 and R602. Gates G600 and G602 form a positive feedback relaxation oscillator enabled by a "low" level on the input. The output comprises a square wave of 1:1 mark-space (i.e. the "on" and "off" portions of the square wave are of equal width) so that the lamp intensity is accordingly reduced. The frequency of the square wave is, for example, 500 Hertz. The square wave signal is provided to the lamp predriver gate G500 as shown in FIG. 11. Each of gates G600 comprises ⅓ of a circuit chip type SCL4023B.

Figure 13:
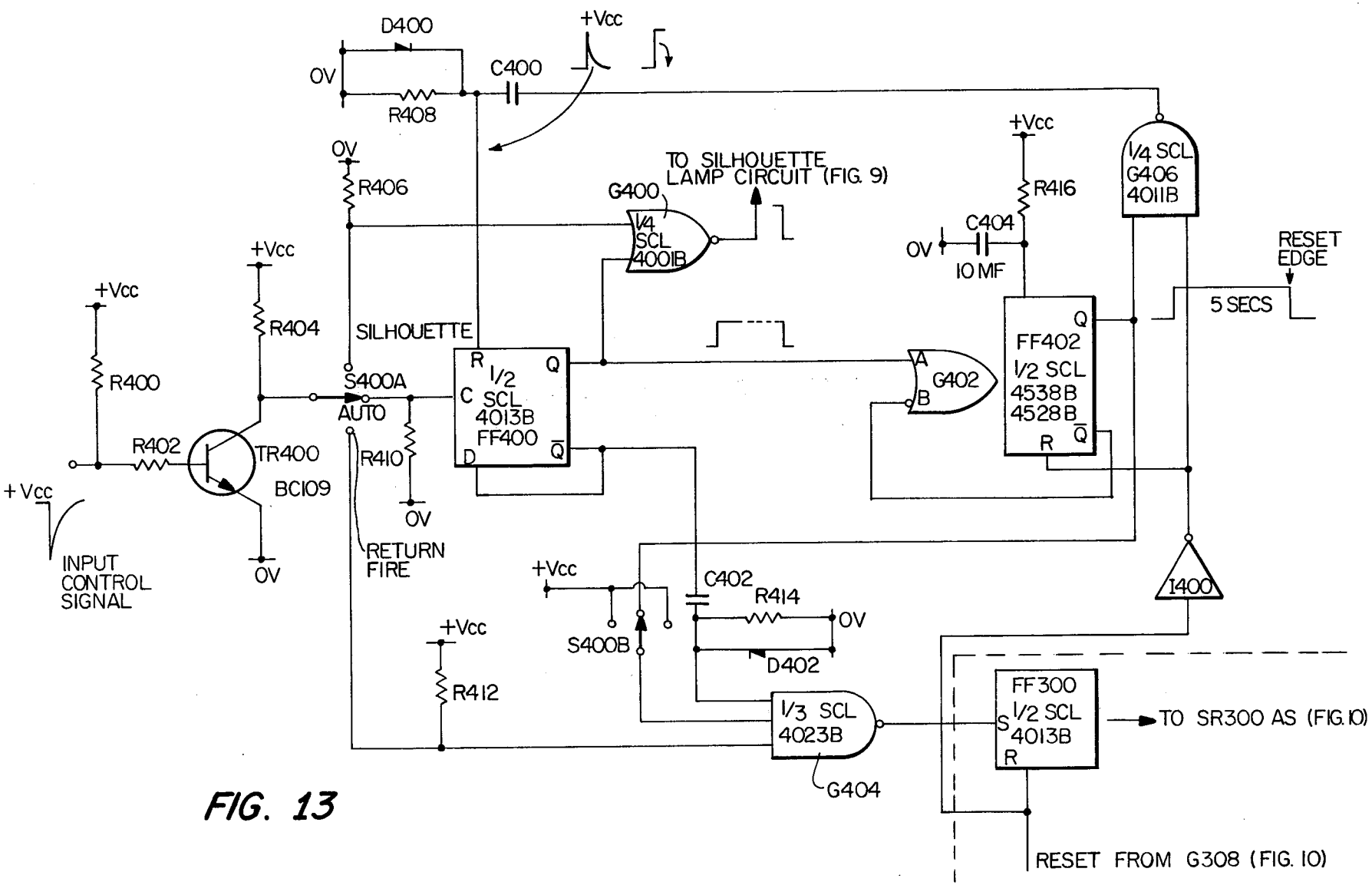
FIG. 13 shows a detailed circuit arrangement which may be used in conjunction with the circuit of FIG. 6 for allowing automatic operation of the silhouette and return fire functions.

FIG. 13 illustrates an optional portion of the circuit which may be used to attain additional advantageous functions. In particular, the circuit of FIG. 13 allows the first received control signal to light the silhouette lamp, wait 5 seconds, and then light the return fire lamp and reset the silhouette lamp if a second input signal is not received within the 5 seconds. If a second input signal is not received, the circuit will automatically reset the silhouette lamp. The input control signal is provided to the junction of resistors R400 and R402 of transistor TR400. The transistor TR400 may be of type BC109, for example, and is coupled to operate as an inverter, with collector resistor R404. The collector of transistor TR400 is coupled to the contacts of selector switch S400A.

With switch S400A (and with it, the contacts of switch S400B) in the return fire position, the negative-going input control signal pulse will pass through the NAND gate G404 and trigger the return fire circuit of FIG. 10. If the optional circuitry of FIG. 13 is used, however, the input transistor TR300 of FIG. 10 will be eliminated and the output of NAND gate G404 will be provided directly to the "S" input of flip-flop FF300, as shown.

With switch S400A (and contacts S400B) switched to the silhouette position, the negative-going input control signal pulse will pass through OR gate G400 and trigger the control circuit of FIG. 9. That is, the output of gate G400 will be provided to the input of delay circuit M2 of FIG. 9.

With switch S400A (and contacts S400B) switched to the "AUTO" position, the first received input control pulse will be inverted by TR400 and will "clock" the flip-flop FF400. The Q output of FF400 will go positive, be inverted by gate G400 and light the silhouette lamp. The Q output of FF400 will also start a 5-second timer comprising gate G402 flip-flop FF402 having an R-C time constant made up of capacitor C404 and resistor R416. Flip-flop FF400 will also set itself up to change state on receipt of the next input control signal, since its Q output, now at logic zero, is tied to the "D" input of FF400.

Assuming now that a second input control signal pulse is received, flip-flop FF400 is clocked again and this time Q changes to logic one (+Vcc), this edge passing through the differentiator comprising capacitor C402 and resistor R414. This initiates the return fire sequence through gate G404, which is enabled, in this mode, only during the 5-second timing period of flip-flop FF402. At the end of the return fire sequence, the return fire reset pulse resets both the 5 second timer (FF402) and the flip-flop FF400.

If no second input control signal pulse is detected, the "end" of 5 second interval "transition edge of FF402 resets FF400, while the Q output of FF402, falling to logic zero, disables gate G404 before the $\overline{Q}$ output of FF400 changes.

Figure 14:
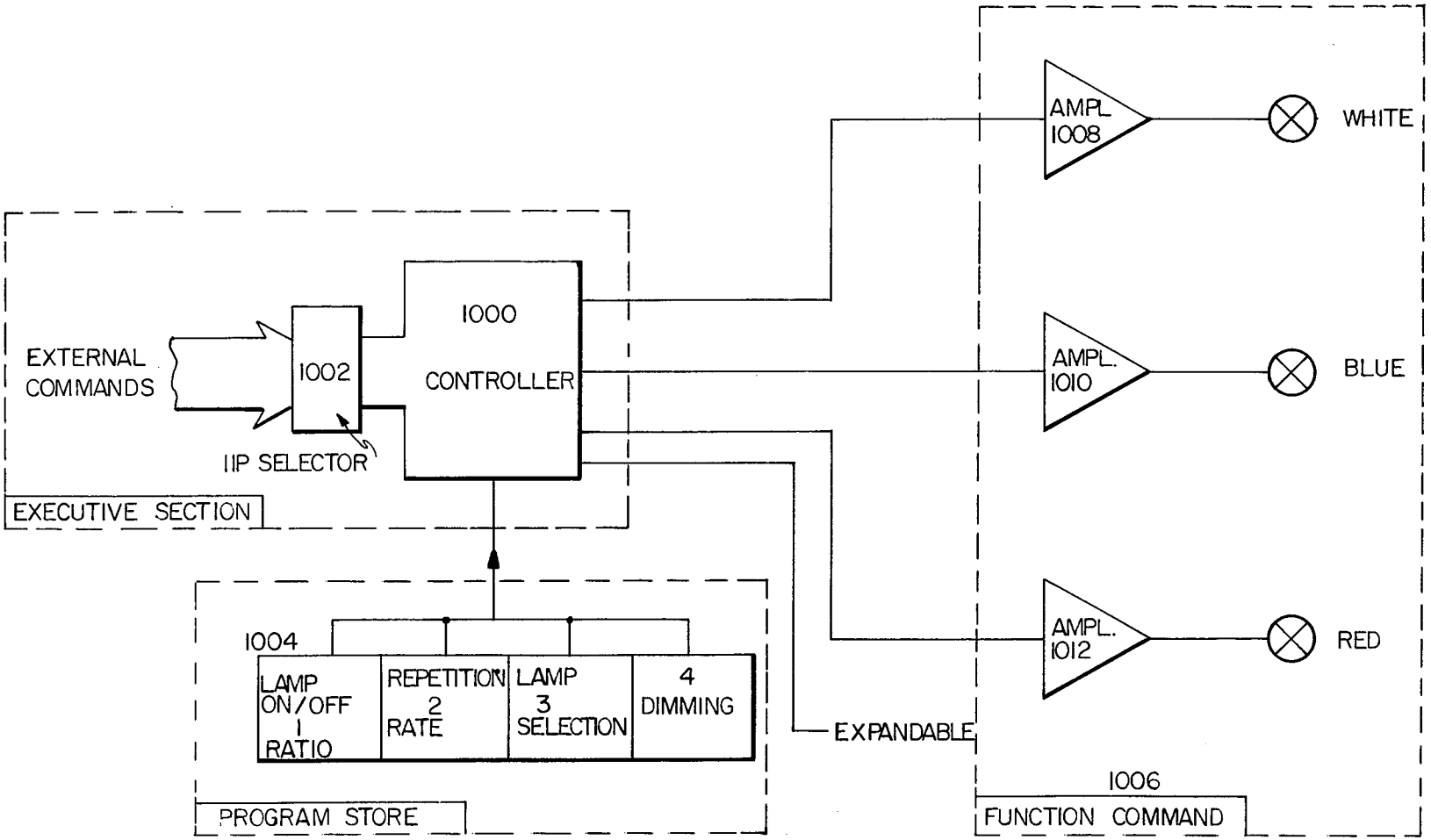
FIG. 14 illustrates in block diagram form an alternate means for implementing the circuitry of FIGS. 6–13 by means of a micro-processor controller with programmable storage.

FIG. 14 shows still a further embodiment for the control circuitry of the night effects simulator. This embodiment is shown only in block form in FIG. 14, and comprises a microprocessor implementation of the circuitry. Block 1000 comprises a single-bit micro-controller (such as Motorola type MC 14500B), which continuously scans an input selector 1002. Input selector 1002 monitors input control lines for detecting the respective control signals such as shown in FIG. 6. The external command signals which are monitored by input selector 1002 include "blue lamp on," "white lamp on," "return fire on," "up signal," "down signal," "bright or dim," and "shut down." These signals may be bypassed to directly control the simulator operation (such as in fixed installations where the simulator is under the control of a hard-wired control console).

Program storage block 1004 includes preset instructions relating to the ratio of lamp on vs. lamp off time, the repetition rate of the return fire sequence (for example, for simulating different weapons), the time of illumination of the lamps (lamp selection), and the dimming control information. These memories may take the form of minature printed-circuit board-mounted switches which address counters, such that the return fire rate may be preset between 1 and 8 flashes and the duration of lamp illumination can also be preset.

Block 1006 comprises the functional command circuitry for energizing the various lamps. Switches 1008–1012 may be implemented in any suitable manner for example as illustrated in FIGS. 7A–7C.

It will thus be seen that the present invention provides a novel and substantially improved target range for providing night effects training. The target is illuminated in three distinct manners and in the desired sequence. A blue light is preferably employed to illuminate the target for sight purposes, with the blue light when positioned behind the target providing a silhouette effect on the target to simulate fleeting moonlight conditions. When the target is hit, such hit is indicated by an immediate white light on the target, and the control circuitry for the simulated range may also provide for dropping of the target after the white light indication. If the target is not hit within a predetermined period of time, simulated return fire, which can be manually controlled by the operator or automatically controlled in accordance with the control circuit, is effected, and such fire is preferably simulated by a red light, or more preferably by a combination of red-orange light to even more accurately simulate the return fire. Reference in the claims to red light is intended to include colored lights which simulate the color of a muzzle flash, such as a combination of red-orange light, preferably a beam which has a red spot in the center and which is surrounded by an orange color. The realistic nature of the return fire can be further enhanced by providing pulsed current to the return fire lamp whereby the light beam is projected on the target in groups of pulses to simulate automatic return fire.

The various control functions can be performed manually by the controller of the range, or can be automatically controlled and sequenced as described. Although silhouette, hit indication and return fire are preferably distinguished one from the other by different light colors, it will be understood that the visually distinguishing characteristics can be achieved by varying light intensity in addition to or in lieu of the various colored lights.

It will further be understood that for existing range installations, portable night effects simulator equipment can be carried into the field and incorporated into the range operation, and the circuitry for the simulator either integrated with or tied into the circuitry for target operation and other control functions for the range.

We claim:

1. A night effects simulator to permit night firing, comprising
   (a) at least one target, and means for supporting said target at a predetermined distance from a firing line,
   (b) first means for at least momentarily illuminating said target for observance by a trainee for firing purposes;
   (c) hit detection means for sensing a target hit;
   (d) second means for illuminating said target responsive to said target hit, said second illuminating means displaying on said target a light visually distinguishable from the light provided by said first illuminating means, and
   (e) third illuminating means for simulating return fire from said target, said third illuminating means displaying on said target a light visually distinguishable from the light provided by said first and second illuminating means, wherein said first illuminating means is positioned behind said target, relative to said firing line, to provide a silhouette effect on said target, and said second and third illuminating means are mounted in front of said target.

2. The simulator of claim 1 further including control means for sequencing as desired said first, second and third illuminating means.

3. The simulator of claim 1 or 2, wherein said first illuminating means displays a blue light on said target, said second illuminating means displays a white light on said target for hit indication, and said third illuminating means displays a red light on said target for realistically simulating return fire.

4. The simulator of claim 1, wherein said second and third illuminating means are mounted in a casing, and further including lens means mounted within said casing through which the light from said second and third illuminating means can be projected, said lens means being constructed and arranged to provide a divergent beam for the light from said second illuminating means so as to fully illuminate said target and to provide a converging light beam from said third illuminating means which forms a spot image on said target to simulate return fire.

5. The simulator of claim 4, wherein said first illuminating means displays a blue light on said target, said second illuminating means displays a white light on said target for hit indication, and said third illumination means displays a red light on said target for realistically simulating return fire.

6. The simulator of claim 5, wherein said third illuminating means for displaying red light simulating return fire on said target includes current pulsing means for providing pulsed current to said third illuminating means so as to display said red light in visually observable bursts, thereby more realistically simulating return fire.

7. The simulator of claims 1, 4, or 5, further including means for adjustably directing said third illuminating means so as to permit the simulated return fire image to appear at the desired location on the target, thereby adapting the simulator for use with targets of varying size and shape.

8. The simulator of claim 7, wherein said adjustable directing means comprises a mirror supported for rotation in said casing, lamp means spaced laterally from said mirror and adapted to reflect light from said mirror through the lens for said third illuminating means onto said target, cam means mounted in said casing and having a surface engaging said mirror, and means operatively connected to said cam means and partially exposed at the exterior of said casing for rotating said cam means, thereby adjusting the cam surface against which said mirror engages, said mirror being resiliently biased against said cam surface.

9. The simulator of claim 8, wherein said mirror is mounted on a supporting member which is in turn pivotally mounted on brackets secured to said casing, and spring means engaging said support member and said bracket for continually resiliently urging said support member against said cam surface.

10. The simulator of claim 4, further including means for producing a control signal responsive to a target hit, and circuit means responsive to said hit control signal for actuating said second illuminating means, the latter being constructed and arranged to display a white light on said target for hit indication.

11. The simulator of claim 10, wherein said means for producing a hit control signal comprises switch means manually initiated by an operator of the range.

12. The simulator of claim 10, wherein said hit control signal is obtained from a hit detection device mounted adjacent said target, the beam of white light being projected on said target immediately following the target hit.

13. The simulator of claim 10, further including a delay circuit for holding said white lamp in an actuated state for a predetermined period of time.

14. The simulator of claim 4, further including control means for producing a silhouette control signal, and circuit means responsive to said signal for actuating said first illuminating means thereby to expose said target to simulated moonlight, said first illuminating means comprising lamp and filter means for providing blue light.

15. The simulator of claim 14, further including a delay circuit for holding said blue lamp in an actuated state for a predetermined period of time.

16. The simulator of claim 4, further including means for producing a return fire control signal, and circuit means responsive to said signal for activating said third illuminating means for a predetermined time duration to simulate retaliatory fire, said third illuminating means including lamp and filter means to provide a beam of projected red light.

17. The simulator of claim 16, wherein said circuit means includes means for providing pulsed current to said lamp thereby to provide pulsed light to said target, thereby more realistically simulating return fire.

18. The simulator of claim 16, further including a delay circuit for holding said red lamp in an actuated state for a predetermined time.

19. The simulator of claim 4, further including control circuit means for sequentially actuating said first illuminating means for displaying light on said target for observance by a trainee, actuating said third illuminating means after a predetermined period of time and in the absence of a target hit for displaying light on said target for simulating return fire, and thereafter again actuating said first illuminating means.

20. The simulator of claim 19, further including a delay circuit for holding said first and third illuminating means in an actuated state for respective predetermined periods of time.

21. The simulator of claim 4, further including control circuit means for sequentially actuating said first illuminating means for displaying light on said target for observance by a trainee, actuating said second illuminating means responsive to a target hit, and thereafter again actuating said first illuminating means.

22. The simulator of claim 21, further including delay circuit means for holding said first and second illuminating means in an actuated state for respective predetermined periods of time.

23. The simulator of claim 21, further including a target moving mechanism associated with said target support means for dropping said target in response to a target hit, the dropping of said target serving to reinforce hit indication.

24. The simulator of claim 4, further including circuit control means for actuating said first illuminating means for displaying light on said target for a predetermined period of time, actuating said third illuminating means in the absence of a target hit or actuating said second illuminating means in the event of a target hit within said predetermined period of time, and again actuating said first illuminating means after light from said second or third illuminating means has been displayed on said target.

25. The simulator of claim 4, further including circuit means for dimming the intensity of light from said first and/or second illuminating means projected onto said target.

26. The simulator of claim 4, further including circuit means for current pulses to said third illuminating means whereby the frequency, duration, and number of said pulses causes said third illuminating means to display light on said target, effectively simulating return fire.

27. The simulator of claim 4, wherein said first illuminating means displays a blue light on said target, said second illuminating means displays a white light on said target for hit indication, and said third illluminating means includes reflective material mounted on the surface of said target and lamp means for projecting light onto said material, said lamp means and reflective material simulating a red image on said target to represent return fire.

28. A night effects simulator to permit night firing, comprising (a) at least one target, and means for supporting said target at a predetermined distance from a firing line;

(b) first means for at least momentarily illuminating said target for observance by a trainee for firing purposes;

(c) hit detection means for sensing a target hit;

(d) second means for illuminating said target responsive to said target hit, said second illuminating means displaying on said target a light visually distinguishable from the light provided by said first illuminating means, and (e) third illuminating means for simulating return fire from said target, said third illuminating means displaying on said target a light visually distinguishable from the light provided by said first and second illuminating means, wherein said first, second and third illuminating means are mounted in a casing positioned in front of said target.

29. The simulator of claim 28, further including control means for sequencing as desired said first, second and third illuminating means.

30. The simulator of claim 29, wherein said first illuminating means displays a blue light on said target, said second illuminating means displays a white light on said target for hit indication, and said third illumination means displays a red light on said target for realistically simulating return fire.

31. The simulator of claim 30, wherein a single lens assembly is mounted in said casing for said first, second and third illuminating means, said lens being constructed and arranged so as to project blue and white light in the desired sequence on said target so as to fully illuminate said target and to project a beam or red light of confined diameter on said target to simulate return fire.

32. The simulator of claim 31, wherein said first, second and third illuminating means comprise independent lamps, and filter means are provided in association with said lamps constituting said first and third illuminating means whereby filtered blue and red light, respectively, are projected on said target when said lamps are actuated.

33. The simulator of claim 32, further including control means for providing pulsed current to said lamp for return fire thereby providing pulsed red light beam projections on said target, said control means including means for varying the periods of pulsed current and thereby varying as desired the duration of the pulsed return fire beam on said target.

34. The simulator of claim 28, further including means for producing a control signal responsive to a target hit, and circuit means responsive to said hit control signal for actuating said second illuminating means, the latter being constructed and arranged to display a white light on said target for hit indication.

35. The simulator of claim 34, wherein said means for producing a hit control signal comprises switch means manually initiated by an operator of the range.

36. The simulator of claim 34, wherein said hit control signal is obtained from a hit detection device mounted adjacent said target, the beam of white light being projected on said target immediately following the target hit.

37. The simulator of claim 34, further including a delay circuit for holding said white lamp in an actuated state for a predetermined period of time.

38. The simulator of claim 28, further including control means for producing a silhouette control signal, and circuit means responsive to said signal for actuating said first illuminating means thereby to expose said target to simulated moonlight said first illuminating means comprising lamp and filter means for providing blue light.

39. The simulator of claim 28, further including a delay circuit for holding said blue lamp in an actuated state for a predetermined period of time.

40. The simulator of claim 28, further including means for producing a return fire control signal, and circuit means responsive to said signal for activating said third illuminating means for a predetermined time duration to simulate retaliatory fire, said third illuminating means including lamp and filter means to provide a beam of projected red light.

41. The simulator of claim 40, wherein said circuit means includes means for providing pulsed current to said lamp thereby to provide pulsed light to said target, thereby more realistically simulating return fire.

42. The simulator of claim 40, further including a delay circuit for holding said red lamp in an actuated state for a predetermined time.

43. The simulator of claim 28, further including control circuit means for sequentially actuating said first illuminating means for displaying light on said target for observance by a trainee, actuating said third illuminating means after a predetermined period of time and in the absence of a target hit for displaying light on said target for simulating return fire, and thereafter again actuating said first illuminating means.

44. The simulator of claim 43, further including a delay circuit for holding said first and third illuminating means in an actuated state for respective predetermined periods of time.

45. The simulator of claim 28, further including control circuit means for sequentially actuating said first illuminating means for displaying light on said target for observance by a trainee, actuating said second illuminating means responsive to a target hit, and thereafter again actuating said first illuminating means.

46. The simulator of claim 45, further including delay circuit means for holding said first and second illuminating means in an actuated state for respective predetermined periods of time.

47. The simulator of claim 45, further including a target moving mechanism associated with said target support means for dropping said target in response to a target hit, the dropping of said target serving to reinforce hit indication.

48. The simulator of claim 28, further including circuit control means for actuating said first illuminating means for displaying light on said target for a predetermined period of time, actuating said third illuminating means in the absence of a target hit or actuating said second illuminating means in the event of a target hit within said predetermined period of time, and again actuating said first illuminating means after light from said second or third illuminating means has been displayed on said target.

49. The simulator of claim 28, further including circuit means for dimming the intensity of light from said first and/or second illuminating means to control the intensity of the blue and white light projected onto said target.

50. The simulator of claim 28, further including circuit means for providing current pulses to said third illuminating means whereby the frequency, duration, and number of said pulses causes said third illuminating means to display light on said target, effectively simulating return fire.

51. The simulator of claim 28, wherein said first illuminating means displays a blue light on said target, said second illuminating means displays a white light on said target for hit indication, and said third illuminating means includes reflective material mounted on the surface of said target and lamp means for projecting light onto said material, said lamp means and reflective material simulating a red image on said target to represent return fire.

* * * * *